United States Patent [19]

Duval et al.

[11] Patent Number: 4,511,283

[45] Date of Patent: Apr. 16, 1985

[54] METHOD AND APPARATUS FOR SEALING OF PAVEMENT SEAMS

[76] Inventors: Henry H. Duval, 3944 Boca Bay Dr., Dallas, Tex. 75234; Donald Kennedy, 9741 E. Lake Highlands Dr., Dallas, Tex. 75218; Milton J. Muesse, 13120 Mitchwin, Dallas, Tex. 75234

[21] Appl. No.: 476,461

[22] Filed: Mar. 18, 1983

[51] Int. Cl.[3] ..... E01C 23/02; B67B 7/24

[52] U.S. Cl. ..... 404/107; 222/4; 222/136; 222/608; 222/399

[58] Field of Search ..... 222/129, 132, 133, 135, 222/136, 173, 608, 626, 373, 386.5, 389, 394, 399, 400.5, 3, 4, 144.5; 404/101, 107; 239/287

[56] References Cited

U.S. PATENT DOCUMENTS

| | | | |
|---|---|---|---|
| 2,530,777 | 11/1950 | Middlestadt | 404/107 |
| 2,578,080 | 12/1951 | Middlestadt | 404/107 |
| 2,648,264 | 8/1953 | Green | 404/107 |
| 2,956,486 | 10/1960 | Siegle | 404/107 |
| 3,130,652 | 4/1964 | Newton, Sr. et al. | 404/107 |
| 3,162,328 | 12/1964 | Frume | 222/386.5 X |
| 3,166,096 | 1/1965 | Lang | 222/386.5 X |
| 3,873,227 | 3/1975 | Goethe et al. | 404/107 |
| 3,987,964 | 10/1976 | Pittman et al. | 239/287 X |

FOREIGN PATENT DOCUMENTS

| | | | |
|---|---|---|---|
| 865243 | 2/1953 | Fed. Rep. of Germany | 222/608 |

*Primary Examiner*—Joseph J. Rolla
*Assistant Examiner*—Michael S. Huppert
*Attorney, Agent, or Firm*—Hubbard, Thurman, Turner & Tucker

[57] ABSTRACT

A method and apparatus for sealing pavement joints or seams is disclosed. The apparatus includes a wheeled support platform which supports an airtight container of sealant composition which hardens upon contact with the atmosphere. A second airtight container includes a supply of water or other liquid. An air compressor is mounted upon the wheeled support platform and compressed air is selectively coupled to the containers of sealant composition and water. An oil film on the surface of the sealant composition is utilized to prevent it from hardening while in the container. A third output of the air compressor and outputs in the water and sealant composition tanks are coupled to a wheeled applicator which is adapted to be moved over the pavement seam. Compressed air is utilized to blow debris out of the pavement seam and a water mist and bead of sealant composition are pneumatically forced through the applicator from the respective containers in response to the selective application of compressed air to the containers.

7 Claims, 3 Drawing Figures

METHOD AND APPARATUS FOR SEALING OF PAVEMENT SEAMS

BACKGROUND OF THE INVENTION

This invention relates to methods and apparatus for sealing pavement joints or seams in general, and in particular to methods and apparatus for sealing pavement seams which do not require the utilization of liquid sealing materials which must be heated to predetermined temperatures to achieve molten states.

It is well known in the prior art that when large expanses of concrete are poured and allowed to harden over a relatively dynamic base, such as soil, subsequent movement of that base will result in fractures and cracks in the concrete. These fractures and cracks are due to temperature and moisture gradients which exist in the concrete due to differences between the temperature and moisture content of the top and the bottom of a pavement slab. In an effort to direct such fractures and cracks along less damaging lines, it has become common practice to produce seams in such concrete expanses by cutting or sawing the concrete after hardening, or by utilizing some flexible material which is imbedded in the concrete while it is still in a plastic state. The utilization of cut or sawed seams is most prevalent in this area, particularly in applications such as parking lots and streets or highways.

It has also become known in the art that some form of flexible sealant must be inserted into such seams to stem the increased flow of surface water into the base beneath these seams. The sealant utilized must be capable of withstanding repeated expansion and contraction as the pavement expands and contracts with temperature and moisture changes. This is particularly important in areas where the soil contains a high clay content as the surface water which flows through such seams will result in a significant expansion of the subsurface soils and have a particularly deleterious effect on the stability of the concrete. Thus, it has become necessary to seal these concrete seams with a waterproof material to prevent damage to the concrete structure. Further, the sealant material must preferably be contained entirely within the seam or gap to prevent its removal if it adheres to the tires of vehicles passing over the seam.

The prior art solution to this problem has consisted almost entirely of expensive and difficult to install modern plastic materials or heated asphaltic materials which are difficult and dangerous to utilize. Numerous examples of devices which utilize asphaltic materials and an accompanying heating device abound in the art. The difficulty in utilizing a heated mass of asphalt and accurately applying such materials into a narrow gap has generally been well recognized; however, no acceptable alternative has been proposed. Thus, while this technique is quite dangerous, it has remained the primary method of sealing pavement seams.

SUMMARY OF THE INVENTION

It is therefore one object of the present invention to provide an improved method of sealing pavement joints or seams.

It is another object of the present invention to provide an improved apparatus for sealing pavement joints or seams.

It is yet another object of the present invention to provide an improved apparatus for sealing pavement joints or seams which does not require a heated mass of sealant compound.

It is another object of the present invention to provide an apparatus for effectively sealing pavement joints or seams with a sealant composition which hardens upon contact with the atmosphere.

It is yet another object of the present invention to provide a method of applying a sealant composition which hardens upon contact with the atmosphere without exposing said sealant composition to the atmosphere until after application.

The foregoing objects are achieved as is now described. The apparatus includes a wheeled support platform which supports an airtight container of sealant composition which hardens upon contact with the atmosphere. A second airtight container includes a supply of water or other liquid. An air compressor is mounted upon the wheeled support platform and compressed air is selectively coupled to the containers of sealant composition and water. An oil film on the surface of the sealant composition is utilized to prevent it from hardening while in the container. A third output of the air compressor and outputs in the water and sealant composition tanks are coupled to a wheeled applicator which is adapted to be moved over the pavement seam. Compressed air is utilized to blow debris out of the pavement seam and a water mist and bead of sealant composition are pneumatically forced through the applicator from the respective containers in response to the selective application of compressed air to the containers.

BRIEF DESCRIPTION OF THE DRAWINGS

The novel features believed characteristic of the invention are set forth in the appended claims. The invention itself; however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
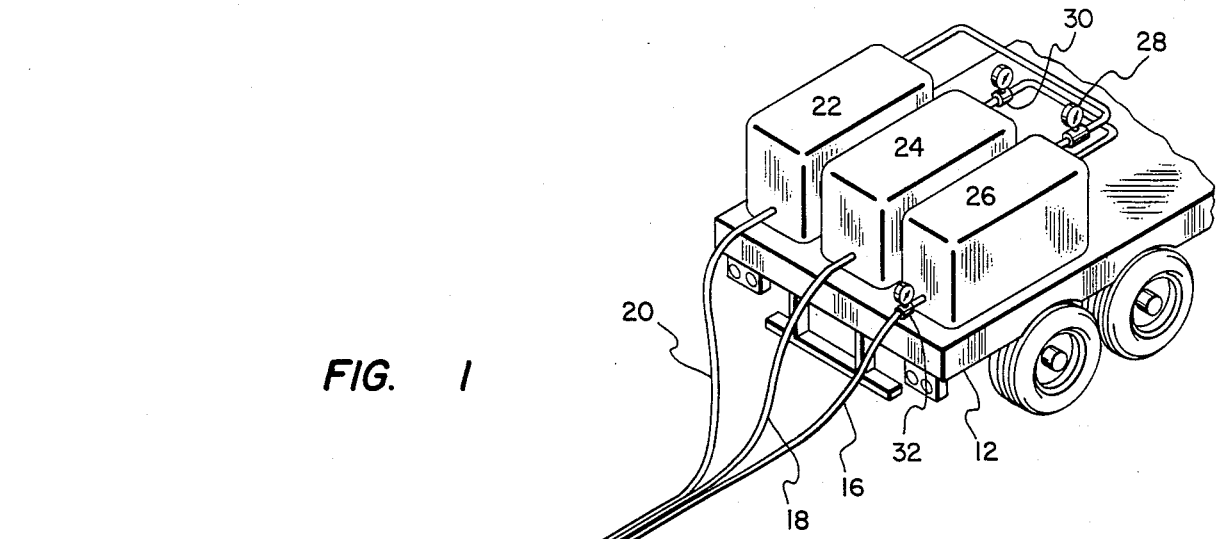
FIG. 1 is a partically schematic perspective view of the novel pavement joint sealing apparatus of the present invention.

With reference now to the figures and in particular with reference to FIG. 1, there is depicted a partially schematic perspective view of the novel pavement seam sealing apparatus of the present invention. As can be seen, the pavement seam sealing apparatus of the present invention includes a wheeled support platform 12 and an applicator 14 which are connected by means of a plurality of elongated hoses 16, 18 and 20. Elongated hoses 16, 18 and 20 may be constructed of any flexible elongated hose-like material which is capable of withstanding the pressures utilized in this application. Those ordinarily skilled in the art will appreciate that wheeled support platform 12 may be implemented utilizing a simple trailer, or may be implemented with the bed of an ordinary pickup truck.

Wheeled support platform 12 serves to support several important aspects of the novel pavement seam sealing apparatus of the present invention including sealant composition tank 22, water tank 24 and air compressor 26, each of which is coupled to applicator 14 by a respective hose. The construction of sealant composition tank 22 is a particularly important feature of the present invention which will be explained in detail with respect to FIG. 3. Air compressor 26, depicted schematically in FIG. 1, may be implemented utilizing any manner of well known portable air compressor, which may be driven by a small displacement gasoline engine, or in the alternative, coupled to the power plant of the vehicle which is utilized to implement wheeled support platform 12.

As can be seen, air compressor 26 is depicted as having a plurality of outputs, each of which is coupled to a pressure regulating valve. That is, one output of air compressor 26 is coupled through pressure regulating valve 28 to sealant composition tank 22, a second output of air compressor 26 is coupled through pressure regulating valve 30 to water tank 24 and a third output of air compressor 26 is coupled through pressure regulating valve 32 and hose 16 to applicator 14. In a preferred embodiment of the present invention, pressure regulating valve 28 is set to provide pressurized air to sealant composition tank 22 at a pressure of approximately seven pounds per square inch. Similarly, pressure regulating valve 30 is set at a pressure of approximately one pound per square inch and pressure regulating valve 32 is set at a pressure of approximately 35 pounds per square inch.

Applicator 14 is also depicted in FIG. 1 and includes a frame 34 which is supported by a plurality of wheels 36, 38 and 40 which are adapted to permit applicator 14 to be moved easily over a joint or seam 42 in pavement 44. Frame 34 serves to support three applicator nozzles in the depicted embodiment, as well as control valves 46. Control valves 46 are implemented utilizing three ordinary valves of a type well known in the prior art which may be utilized to selectively permit sealant composition, water and air to be applied to seam 42. Applicator 14 also includes a handle 48 which permits applicator 14 to be easily directed by an operator.

Figure 2:
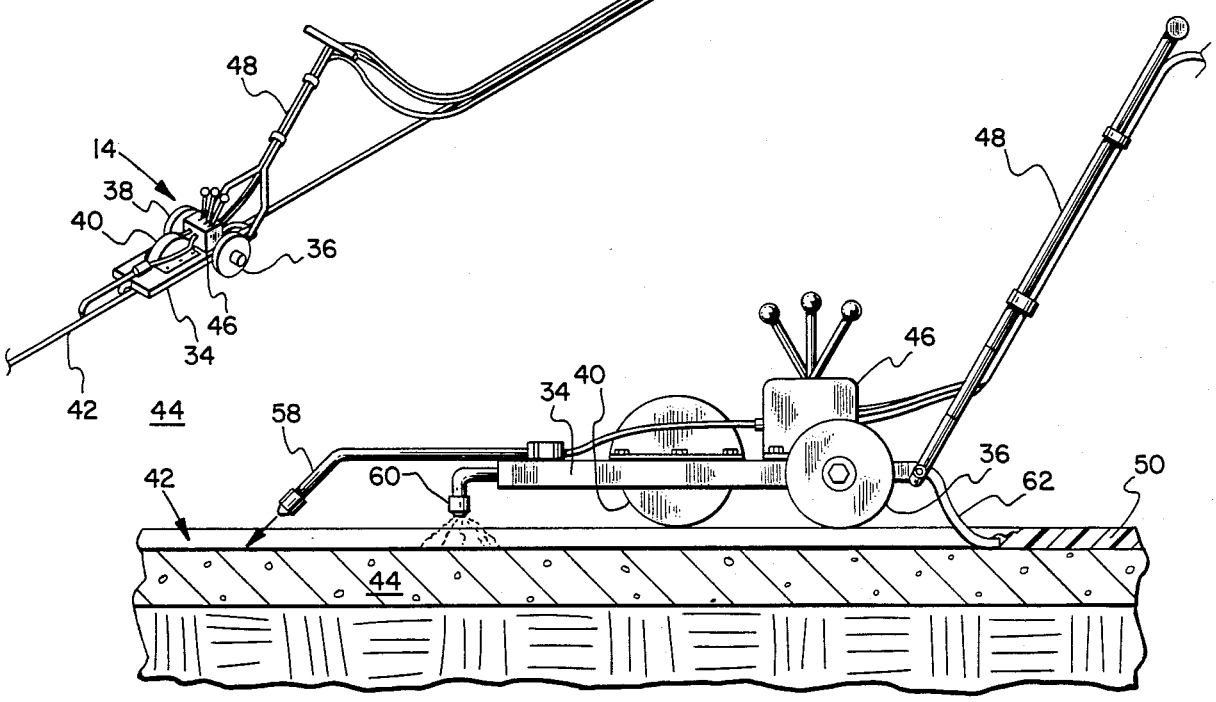
FIG. 2 is a partially sectional view of the applicator of the novel joint sealing apparatus of the present invention.

With reference now to FIG. 2, there is depicted a partially sectional view of applicator 14 of the present invention. As can be seen, applicator 14 includes a wheeled frame 34 which may be directed by means of handle 48. Wheeled frame 34 serves to support control valves 46 and three separate applicator nozzles. Applicator nozzle 58 is utilized to apply compressed air to seam 42 in order to remove all laitance, dirt, dust and other objectionable material from seam 42. In the operation of applicator 14, the compressed air supply to applicator nozzle 58 is the first of control valves 46 to be opened as applicator 14 is operated over seam 42. Next, applicator nozzle 60 is utilized to spray a fine mist of water into seam 42 to clean seam 42 and to enhance the bonding of the sealant composition. As applicator 14 is moved over seam 42, control valves 46 are utilized to supply pressurized water to applicator nozzle 60. Finally, applicator nozzle 62 is utilized to feed sealant composition 50 into seam 42. Applicator nozzle 62 is designed, in the depicted embodiment, to be inserted down into seam 42 in order that sealant composition 50 may fill seam 42 solidly from the bottom of seam 42 upward. This is particularly important in that any amount of sealant composition 50 which spills over the top of seam 42 onto the surface of pavement 44 may be picked up by vehicle tires or the like. In a preferred embodiment of the present invention, applicator nozzle 62 is constructed of synthetic fluorine, low friction tubing such as Teflon TM tubing, manufactured by E. I. DuPont De Nemours.

Figure 3:
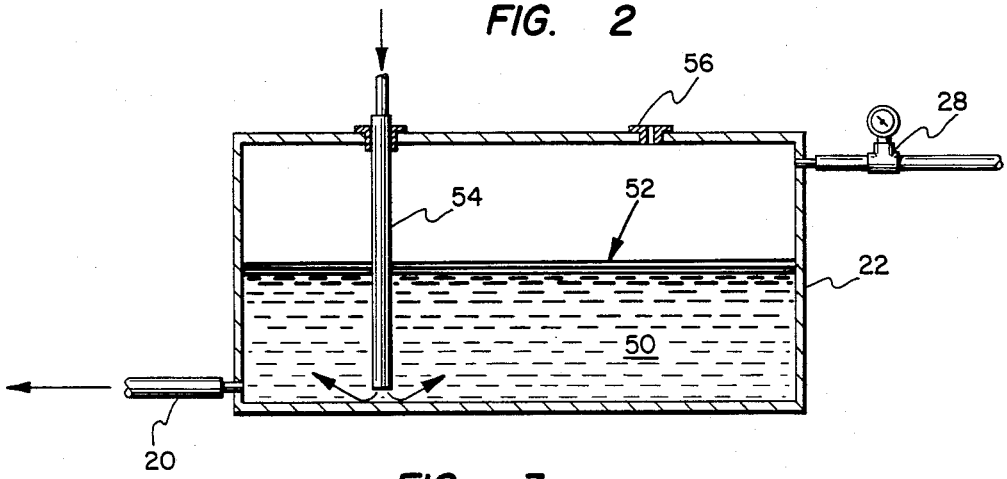
FIG. 3 is a sectional view of the sealant composition tank of the novel pavement joint sealing apparatus of the present invention.

With reference now to FIG. 3, there is depicted a sectional view of sealant composition tank 22 of the present invention which illustrates an important aspect of the present invention. Unlike previously known pavement seam sealers, which utilized an asphaltic mass which must be heated to a molten state, the pavement seam sealer of the present invention utilizes a cold applied rubberized asphalt emulsion. This emulsion is a homogenous blend of asphalt, rubber, inert filler and water and provides a resilient, adhesive compound capable of sealing properly cleaned joints in concrete pavements against the infiltration of moisture throughout repeated cycles of contraction and expansion. The emulsion utilized in a preferred embodiment of the present invention will meet the following requirements when tested in accordance with Federal Specifications SS-S-156:

Asphalt Emulsion

Viscosity (122° F.): 100+ sec.
Settlement (5 day): 1%
Adhesion: Good
Workability: Good
Latex Rubber (Butadiene/Styrene Ratio 70/30): 10%±1
Residual Asphalt: 60–70%

Asphalt Residue

Penetration 77°, 100 g): 40–70
Softening Point: 120°–150° F.
Ductility: 200+ cm
Bond: There shall be no cracking of the material or failure in bond between the material and mortar test blocks during or at the end of five cycles.

While such cold applied rubberized asphalt emulsions are known in the art, they have not been utilized in prior art pavement seam sealers due to a particular characteristic of such mixtures. That is, cold applied rubberized asphalt emulsions will cure or harden rapidly after exposure to the atmosphere. This characteristic has rendered such emulsions practically useless in pavement seam sealing applications due to the difficulty in applying a bead of such sealant to a pavement seam without exposing it to the atmosphere prior to application. The novel pavement seam sealing device of the present invention solves this problem and permits this cold applied rubberized asphalt emulsion to be safely and efficiently applied to a pavement seam.

Referring again to FIG. 3, there is depicted a sectional view of sealant composition tank 22 of the present invention. Sealant composition tank 22 is seen to enclose a mass of sealant composition 50 and includes an outlet hose 20 which is coupled to applicator 14 (see FIG. 1). Sealant composition tank 22 includes a fill tube 54 which may be utilized to replenish the store of sealant composition 50. As can be seen, fill tube 54 includes an elongated tube which permits sealant composition 50 to be added to sealant composition tank 22 at or near the bottom of sealant composition tank 22. A relief valve 56 is provided in the top surface of sealant composition tank 22 to permit the air displaced by sealant composition 50 to be released from sealant composition tank 22.

A film of ordinary oil 52 is included within sealant composition tank 22 and disposed on the surface of sealant composition 50 to prevent sealant composition 50 from contacting the air within sealant composition tank 22.

During operation of the pavement seam sealing device of the present invention, fill tube 54 and relief valve 56 are closed and pressurized air is applied to sealant composition tank 22 via pressure regulating valve 28 from air compressor 26 (see FIG. 1). The pressurized air which is coupled into sealant composition tank 22 pneumatically forces sealant composition 50 out through hose 20 to applicator 14 and applicator nozzle 62. In this manner, the cold applied rubberized asphalt emulsion utilized in the present invention may be contained in a manner which isolates the emulsion from the atmosphere and may be safely and simply coupled to an applicator nozzle without exposing the asphalt emulsion to the hardening effects of air until after the emulsion has been inserted into the pavement seam.

Although the invention has been described with reference to a specific embodiment, this description is not meant to be construed in a limiting sense. Various modifications of the disclosed embodiment as well as alternative embodiments of the invention will become apparent to persons skilled in the art upon reference to the description of the invention. It is therefore contemplated that the appended claims will cover any such modifications or embodiments that fall within the true scope of the invention.

What is claimed is:

1. A dispensing apparatus for filling the gap between pavement sections with a sealant composition comprising:

a wheeled support platform movable over said pavement sections;

a first container disposed on said wheeled support platform and containing a liquid sealant composition;

a second container disposed on said wheeled support platform and containing water;

a source of compressed air disposed on said wheeled support platform having a plurality of outputs, a first output of said plurality of outputs coupled to said first container and a second output coupled to said second container; and an applicator adapted to move over said gap in said pavement sections, said applicator including a first applicator nozzle coupled to a source of compressed air and disposed so as to remove dust and loose debris from said gap, a second applicator nozzle coupled to said second container and disposed so as to moisten said gap after said dust and loose debris have been removed and a third applicator nozzle coupled to said first container and disposed so as to fill said gap with said liquid sealant composition after said dust and loose debris have been removed and said gap has been moistened.

2. The dispensing apparatus according to claim 1 wherein said wheeled support platform comprises the bed of a truck.

3. The dispensing apparatus according to claim 1 wherein said liquid sealant composition comprises a homogenous blend of asphalt, rubber, inert filler and water.

4. The dispensing apparatus according to claim 1 wherein said source of compressed air comprises an air compressor driven by an internal combustion engine.

5. The dispensing apparatus according to claim 4 further including air pressure regulating valves coupling said air compressor to said first and second containers.

6. The dispensing apparatus according to claim 1 wherein said third applicator nozzle comprises a Teflon tube.

7. The dispensing apparatus according to claim 1 wherein said applicator comprises a wheeled support frame adapted to support said first, second and third applicator nozzles.

* * * * *